US006166316A

United States Patent [19]

Takahashi et al.

[11] Patent Number: 6,166,316

[45] Date of Patent: Dec. 26, 2000

[54] AUTOMATIC PERFORMANCE APPARATUS WITH VARIABLE ARPEGGIO PATTERN

[75] Inventors: Makoto Takahashi; Yoshihisa Ito, both of Hamamatsu, Japan

[73] Assignee: Yamaha Corporation, Hamamatsu, Japan

[21] Appl. No.: 09/369,787

[22] Filed: Aug. 6, 1999

[30] Foreign Application Priority Data

Aug. 19, 1998 [JP] Japan ..... 10-232937

[51] Int. Cl.[7] ..... G10H 1/20; G10H 1/28; G10H 1/42; G10H 1/46

[52] U.S. Cl. ..... 84/619; 84/633; 84/636; 84/638; 84/657; 84/665; 84/668

[58] Field of Search ..... 84/619, 626–633, 84/638, 657, 662–665, 685, 701–711, 716, 445–449, 636, 668

[56] References Cited

U.S. PATENT DOCUMENTS

| | | | |
|---|---|---|---|
| 4,179,970 | 12/1979 | Faulkner | 84/716 |
| 4,182,212 | 1/1980 | Issi | 84/716 |
| 4,206,676 | 6/1980 | Adachi et al. | 84/716 X |
| 4,275,634 | 6/1981 | Imamura et al. . | |
| 4,444,081 | 4/1984 | Jones et al. | 84/638 |
| 5,003,860 | 4/1991 | Minamitaka . | |
| 5,155,286 | 10/1992 | Saito et al. . | |
| 5,714,705 | 2/1998 | Kishimoto et al. . | |

FOREIGN PATENT DOCUMENTS 2 732 804 10/1996 France .

*Primary Examiner*—Stanley J. Witkowski
*Attorney, Agent, or Firm*—Morrison & Foerster

[57] ABSTRACT

An automatic performance apparatus that is responsive to a manual player of an input implement for producing either an arpeggio performance or a pattern performance in a modified form. Specifically, the present invention includes: a sequencer block that is responsive to manual play for generating a sequence of original note data representing either the arpeggio performance or the pattern performance; an input block to set control parameters; a play effector block to process the original note data according to the control parameters; a transposer block that shifts the altered note data by a predetermined interval to thereby generate shifted note data; a note effector block that generates additional note data in superposed relation to the shifted note data; a tone generator block that is receptive of the shifted note data and the additional note data for generating corresponding musical tones to thereby provide the modified form of either of the arpeggio performance and the pattern performance.

17 Claims, 3 Drawing Sheets

AUTOMATIC PERFORMANCE APPARATUS WITH VARIABLE ARPEGGIO PATTERN

BACKGROUND OF THE INVENTION

The present invention generally relates to an automatic performance apparatus that allows a wide variety of automatic performance in which properties of performance tones and performance contents can be varied real-time.

Automatic performance apparatuses are conventionally available in which either of an arpeggio performance and a pattern performance are created. In the arpeggio performance, notes corresponding to keys depressed on a music keyboard are sequentially played according to arpeggio patterns such as up, down, alternate (up-down), and random. Generally, arpeggio means production of the tones of a chord in rapid succession rather than simultaneously. On the other hand, in the pattern performance, a plurality of prestored performance patterns are assigned to a plurality of keys of a music keyboard beforehand, and one performance pattern corresponding to one depressed key is reproduced.

However, in order to give fullness or richness to music tones or in order to vary the properties thereof in the arpeggio performance or the pattern performance by generating plural tones for one note, the conventional apparatuses must have a capability of generating plural tones for one note on the side of a tone generator.

In order to generate arpeggio performance tones or pattern performance tones of different pitches without depressing other keys than a target key in the arpeggio performance or the pattern performance, so-called transposition must be set on the side of the tone generator, making the operation very cumbersome.

Further, the user sometimes wants to make a wide variety of the arpeggio performance or the pattern performance by varying the contents thereof. However, the performance contents can be varied only by positioning a cursor to various parameters displayed on a display and by changing the parameter values with "+/−" switches, for example. Therefore, it is practically impossible to vary real-time the performance contents of the arpeggio performance or the pattern performance during the course of automatic performance.

SUMMARY OF THE INVENTION

It is therefore an object of the present invention to provide an automatic performance apparatus that allows a wide variety of automatic performance in which properties of performance tones and performance contents can be changed real-time.

In carrying out the invention and according to one aspect thereof, there is provided an automatic performance apparatus comprising: a sequencer block (AR, PS) for generating note data corresponding to an arpeggio performance or a pattern performance according to a key operation; a note effector block (NE) for generating additional note data overlapped with the original note data supplied from the sequencer block, the additional note data being substantially the same as the original note data in pitch, or substantially the same in pitch name but different in octave, or separated from the original note data by a preset interval; and a tone generator block (TS) for receiving both pieces of the overlapped original and additional note data from the note effector block to generate tones corresponding to both pieces of the overlapped note data.

In carrying out the invention and according to another aspect thereof, there is provided an automatic performance apparatus comprising: a sequencer block (AR, PS) for generating original note data corresponding to an arpeggio performance or a pattern performance in response to a key operation; a transposer block (TP) for generating note data obtained by shifting the original note data supplied from the sequencer block by a predetermined interval; and a tone generator block (TS) for receiving the shifted note data from the transposer block to generate music tones corresponding to the shifted note data.

In carrying out the invention and according to still another aspect thereof, there is provided an automatic performance apparatus comprising: operation controls (15N1) for specifying performance tone parameters such as a tempo, timing, time duration, and volume of note data; a sequencer block (AR, PS) for generating note data corresponding to an arpeggio performance or a pattern performance in response to a key operation; a play effector block (PE) for manipulating the note data supplied from the sequencer block according to the performance tone parameters; and a tone generator block (TS) for receiving the manipulated note data from the play effector block to generate tones corresponding to the manipulated note data.

In carrying out the invention and according to yet another aspect thereof, there is provided an automatic performance apparatus comprising: an input block (15, 17) having a plurality of operating controls (15N1, Ntp, 15N2) for specifying performance tone parameters such as a tempo, timing, time duration, and volume of note data, a shift parameter for shifting note data interval, and an additional tone parameter for adding a tone to note data; a sequencer block (AR, PS) for generating note data corresponding to an arpeggio performance or a pattern performance in response to a key operation; a note effector block (PE) for manipulating the note data according to the performance tone parameters; a transposer block (TP) for shifting the note data according to an interval shift amount (Ntp) by a predetermined interval; a play effector block (PE) for overlapping, on the shifted note data, additional note data which is substantially the same as the shifted note data in pitch, or substantially the same in pitch name but different in octave, or separated from shifted the note data by a preset interval according to an interval relation; and a tone generator block (TS) for receiving both pieces of the overlapped note data to generate tones corresponding to both pieces of the overlapped note data.

According to the automatic performance apparatus of the invention, on the original note data of the arpeggio performance or the original note data of the automatic performance, additional note data having the same pitch as that of the original note data of the arpeggio performance or the pattern performance is overlapped, the additional note data having the same pitch name but a different octave is overlapped, or the additional note data separated from the note data of the arpeggio performance or the pattern performance by a preset interval is overlapped. The additional note data is sent to the tone generator block together with the original note data. Consequently, even if the tone generator block has no capability of generating plural tones for one note, desired fullness can be given to tones of the arpeggio performance or the pattern performance, or tone properties thereof can be changed by generating plural tones for one note.

According to the automatic performance apparatus of the invention, the note data of arpeggio performance and the note data of pattern performance are shifted by a predetermined interval, and the shifted note data are supplied to the tone generator block. Consequently, the arpeggio performance tones and the pattern performance tones having different pitches can be generated without depressing other keys than a target key even if transposition is not set on the side of the tone generator block.

In the present invention, the operator panel of the automatic performance apparatus is provided with controls for changing real-time the performance tone parameters associated with the arpeggio performance tones and the pattern performance tones such as time stretch, clock shift, gate time, and velocity offset. Consequently, the performance contents of the arpeggio performance and the pattern performance can be changed in real-time with ease during the course of the music performance.

In the present invention, the operator panel of the automatic performance apparatus is further provided with the controls for changing real-time the shift parameter for interval shifting including a transpose value, and the additional tone parameters such as the number of additional tones having the same pitch, the octave values of additional tones, and the interval values of additional tones. Consequently, not only the contents of the performance but also the transposition shift amounts, the number of additional notes, and additional note intervals can be changed real-time with ease, thereby realizing a wide variety of automatic performance in which the tone properties of the automatic performance and the contents of the automatic performance vary real-time.

DETAILED DESCRIPTION OF THE INVENTION

This invention will be described in further detail by way of example with reference to the accompanying drawings. It should be noted that, while preferred embodiments of the present invention have been described using specific terms, such description is for illustrative purposes only, and it is to be understood that changes and variations may be made without departing from the spirit or scope of the appended claims.

[Hardware configuration]

Figure 1:
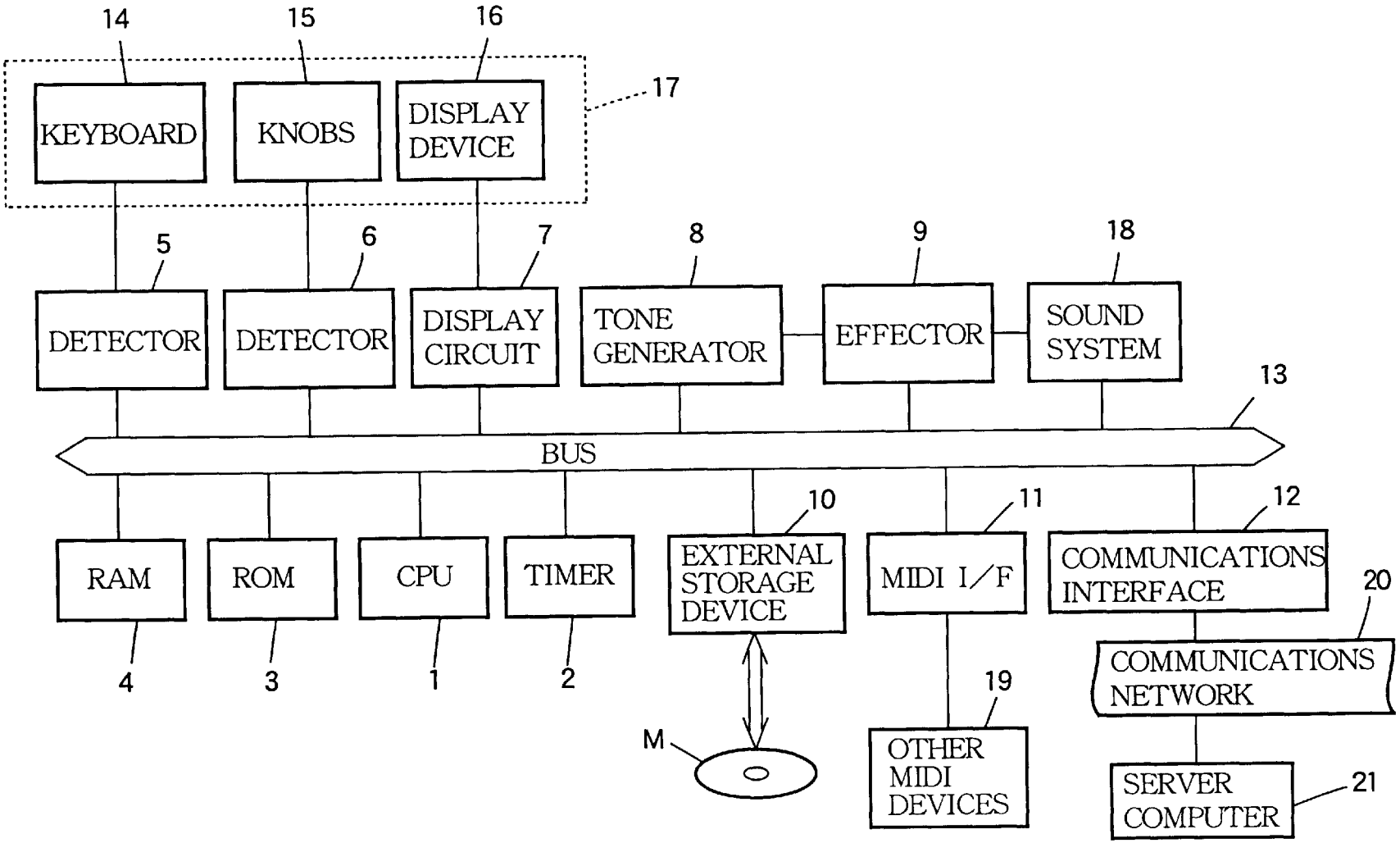
FIG. 1 is a block diagram illustrating a hardware configuration of an automatic performance apparatus practiced as one preferred embodiment of the invention.

Now, referring to FIG. 1, there is shown the hardware configuration of an automatic performance apparatus practiced as one embodiment of the invention. In this embodiment, the automatic performance apparatus is composed of a central processing unit (CPU) 1, a timer 2, a read-only memory (ROM) 3, a random access memory (RAM) 4, a first detector 5, a second detector 6, a display circuit 7, a tone generator 8, an effector 9, an external storage device 10, a MIDI (Musical Instrument Digital Interface) interface (I/F) 11, and a communications interface 12, those of which are interconnected through a bus 13. It should be noted that the MIDI interface 11 is not necessarily limited to a dedicated MIDI interface; it may be RS-232C, USB (Universal Serial Bus), IEEE 1394, or other general-purpose interfaces.

The first detector 5 and the second detector 6 are connected with a switch input device such as a key board 14 and a variable input device such as knobs 15, respectively. The display circuit 7 is connected with a monitor display device 16, which is composed of a liquid crystal panel. These devices 14 through 16 may be arranged on an operator panel 17. The effector 9 is connected with a sound system 18 for sounding tones on the basis of the performance data supplied from the tone generator 8. The system according to the present invention is connected to other MIDI devices 19 such as a keyboard device and an external tone generator through the MIDI interface 11, and exchanges various note data with these external music information processing devices as required. The communications interface 12 is communicatively connected to a server computer 21 through a communications network 20 such as a LAN (Local Area Network), the Internet, or a telephone line.

It should be noted that the system according to the present invention may be embodied in not only an electronic musical instrument but also in a personal computer installed with application software. Therefore, the system according to the present invention may have the same configuration as that of a personal computer system with a built-in tone generator or a sequencer having a hard disk drive, a tone generator and a display device. Consequently, the application software can be supplied to the system as stored in a machine readable recording medium M such as a magnetic disk, an optical disk, or a semiconductor memory by use of the external storage device 10.

When the invention is embodied in an electronic musical instrument, such an embodiment may be not only a keyboard instrument but also a string instrument or a percussion instrument. Moreover, the tone generator and an automatic performance apparatus may be integrated in a frame of a single electronic musical instrument, or they may be discrete devices interconnected by use of the above-mentioned MIDI device or communications means such as networks.

The CPU 1 is provided for controlling the system in its entirety, and is connected to the timer 2 for generating a clock signal for use by interrupt processing or for use as a tempo clock. Especially, the CPU 1 executes various processing capabilities necessary for the automatic performance. The ROM 3 stores predetermined control programs for controlling this system. These control programs include various processing programs associated with the automatic performance. The RAM 4 functions as a work area for executing these processing programs, and for storing necessary performance data and parameters.

The first detector 5 and the second detector 6 detect input information from the keyboard input device 14 and the knob input device 15, respectively. The display circuit 7 creates required graphic information associated with the automatic performance, and displays the received information through the bus 13 on a main display screen or various indicators of the display device 16. The input device 14 has a keyboard and switch-type controls such as performance mode selector key switches necessary for executing automatic performance operations. The other input device 15 includes variable controls for setting various parameters necessary for the automatic performance. By use of the input devices 14 and 15, the user can input commands, selections, and data. In this embodiment, the operator controls and the display device are arranged on the operator panel 17.

[Tone generator]

The tone generator 8 and the effector 9 can sound automatic performance tones through the sound system 18 by use of the note data based on inputted performance information. The tone generator 8 through the sound system 18 may also be configured to reproduce the internal note data in the system or the external note data supplied from the MIDI device 19 as required.

Therefore, the combination of the tone generator 8 and the effector 9 may be practiced as various configurations. For example, the type of the tone generator 8 may be any of waveform memory, FM, physical mode, harmonics synthesis, formant, and "VCO+VCF+VCA" analog-type synthesizer. The tone generator 8 may be configured by not only dedicated hardware but also software such as "DSP (Digital Signal Processor)+microprogram" or "CPU+software program." In addition, the tone generator 8 may be formed by plural sounding channels by use of one circuit in a time division manner, or may have a configuration in which one sounding channel is constructed by one circuit.

[Automatic performance data]

The automatic performance data or note data for use in the present invention may be practiced in various formats. For example, the format of the performance data may be any of "event+relative time" in which a performance event occurrence time is expressed in a time measured from the immediately preceding event, "event+relative time" in which a performance event time is expressed in an absolute time within a song or a measure, "pitch (rest)+note length" expressed in a note pitch and a note length or a rest and a rest length, and "full method" in which a memory area is allocated for each minimum resolution of performance in advance and a performance event is stored in a memory area corresponding to a performance event occurrence time.

The method of changing automatic performance tempo may be any of changing the period of tempo clock, changing time data without changing the frequency of tempo clock, and changing the value of counting timing data in one processing operation.

Moreover, the automatic performance data may be formed in which the data of plural channels coexist or the data of each channel is arranged in each track.

The performance data may be stored such that time-series of the performance data are stored in a continuous area, or data stored in discrete areas are controlled separately as continuous data. Namely, the performance data may be controlled as time-series continuous data, regardless of whether the performance data is stored continuously or not in a memory.

[Recording medium]

The external storage device 10 may be any of a hard disk drive (HDD), a floppy disk drive (FDD), a CD-ROM (Compact Disk Read Only Memory) drive, a magneto-optical (MO) disk drive, a DVD (Digital Video Disk) drive, and so on. The recording medium M of the external storage device 10 stores song data including various pieces of backing data in a MIDI format, for example.

As described above, the control programs stored in the ROM 3 include various processing programs associated with the generation of performance information according to the invention. These processing programs may be supplied to the system from the external storage device 10 using the medium M such as magnetic disk, optical disk, or semiconductor memory. Alternatively, these processing programs may be supplied through the communications network 20. The following describes an example in which an HDD is used to supply the control programs including various processing programs.

[Use of HDD or CD-ROM drive]

An HDD is a storage device for storing control programs and various data on a hard disk (HD). For example, if the ROM 3 stores no control program, it is stored on the hard disk of the HDD and is loaded into the RAM 4 to make the CPU 1 execute the programs in the same manner as when the control programs are stored in the ROM 3. Storing the control programs on the HDD facilitates their expansion or upgrading.

On the other hand, a CD-ROM (Compact Disk Read Only Memory) drive is a device from which control programs and various data stored on a portable CD-ROM are retrieved. Therefore, storing control programs and various data on the CD-ROM and transferring them to the hard disk of the HDD allows the CPU 1 to execute the programs in the same manner as when the control programs are stored in the ROM 3. This facilitates the new installation and upgrading of the control programs.

In addition to the above-mentioned CD-ROM drive, various other storage devices are available such as removable and portable FDD and MO drive. In addition to the HDD, the user can install any of these storage devices. In such a case, if a loaded recording medium is writable as with a floppy disk (FD), the data obtained in the system may be written to the recording medium for use outside the system.

[Downloading of program through network]

If no control program is stored in the ROM 3, the communications interface 12 may be used to download control programs and various data from the server computer 21. In this case, the system shown in FIG. 1, which is a client, sends a command to the server computer 21, requesting for the downloading of a particular program or data through the communications interface 12 and the communications network 20. Having received the command, the server computer 21 distributes the requested program and data over the communications network 20. Therefore, these program and data are received by the system through the communications interface 12, and are stored on the hard disk of the HDD, upon which the downloading completes.

[General Configuration of functional blocks]

Figure 2:
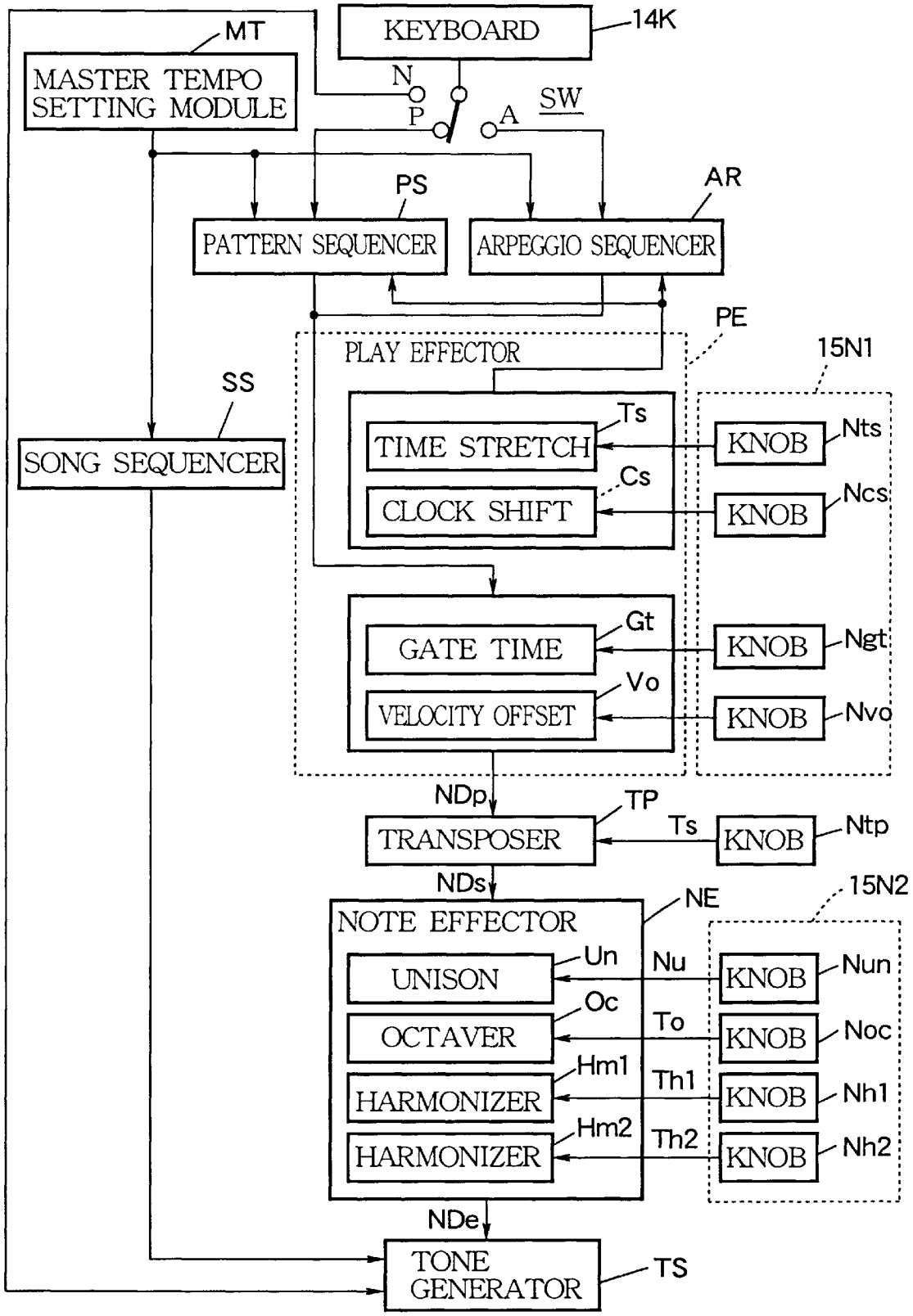
FIG. 2 is a block diagram illustrating a general function of the automatic performance apparatus according to the invention.

Now, referring to FIG. 2, there is shown a general block diagram illustrating the capability of the inventive automatic performance apparatus practiced as one embodiment of the invention. A signal generated from a keyboard 14K of the input device 14 is sent to an arpeggio sequencer module AR, a pattern sequencer module PS, or a tone generator module TS according to the operation of an arpeggio performance key A, a pattern performance key P, or a normal performance key N on a performance mode selector switch SW. A tempo clock set by a master tempo setting module MT is sent to the arpeggio sequencer module AR, the pattern sequencer module PS, and a song sequencer module SS connected to the tone generator module TS, thereby controlling the progression of the processing operations of these modules. It should be noted that the tone generator module TS need not have a capability of generating plural tones for one note.

The pattern sequencer PS executes the pattern performance in which a plurality of prestored performance patterns are assigned to a plurality of keys beforehand so that one performance pattern corresponding to a depressed key is reproduced. Each of the assigned performance patterns is composed of plural tracks. In the pattern performance, a selected performance pattern is repeatedly played until a next key is depressed. When a next key is depressed or at the beginning of a next measure, another performance pattern assigned to the next key starts.

The arpeggio sequencer module AR executes the arpeggio performance in which notes corresponding to keys depressed on the keyboard 14K are sequentially sounded according to arpeggio patterns such as up, down, alternate (up/down), and random. Generally, arpeggio means production of the tones of a chord in rapid succession rather than simultaneously. The tones to be sounded in this arpeggio performance are, in "one octave," only chords of the depressed keys and, in "two octaves," chords of the depressed keys and chords one octave higher.

A play effector PE manipulates or alters real-time the notes generated by the arpeggio sequencer AR and the pattern sequencer PS. Specifying four kinds of performance parameters with the operator controls allows the play effector PE to impart four effects at a time. The four kinds of performance parameters and corresponding effects are as follows.

(1) Time stretch Ts

Time stretch Ts is an effect for controlling an arpeggio tempo or a pattern reproduction tempo independently of the master tempo. To be more specific, the time stretch Ts changes the tempo by manipulating the timing data read from the note data. This tempo can be controlled by operating a time stretch knob Nts in a first effect knob group 15N1 on the input device 15, or the operator panel 17. By concurrent use of a track specifying operation, the tempo of only a particular track of the plural tracks produced from the pattern sequencer PS can be changed or modified.

(2) Clock shift Cs

Clock shift is an effect for minutely shifting forward or backward the sounding pattern of the arpeggio performance or the pattern performance. To be more specific, this effect shifts forward or backward a pattern read position by a predetermined amount. The shift amount can be controlled by operating a clock shift knob Ncs in the first effect knob group 15N1.

(3) Gate time Gt

Gate time Gt is an effect for expanding or contracting the gate time (sounding time duration) of a note of the arpeggio performance or the pattern performance. To be more specific, this effect manipulates the gate time data read from the note data. The amount of gate time expansion or contraction can be controlled by operating a gate time knob Ngt in the first effect knob group 15N1.

(4) Velocity offset Vo

Velocity offset Vo is an effect for increasing or decreasing the velocity (sounding volume) of a note of the arpeggio performance or the pattern performance. To be more specific, this effect manipulates velocity data read from the note data by an offset amount. The offset amount can be controlled by operating a velocity offset knob Nvo in the effect knob group 15N.

As described above, the inventive automatic performance apparatus is responsive to a manual play of an input implement such as the keyboard 14K for producing either of an arpeggio performance and a pattern performance in a modified form. In the inventive apparatus, the sequencer block AR or PS is responsive to the manual play for generating a sequence of original note data representing either of the arpeggio performance and the pattern performance. The input block 15N1 is manually operable to set control parameters effective to control at least one of a tempo, a timing, a duration and a volume of the original note data. The play effector block PE processes the original note data according to the control parameters to generate altered note data. The tone generator block TS is receptive of the altered note data for generating corresponding musical tones to thereby provide the modified form of either of the arpeggio performance and the pattern performance. Preferably, the input block 15N1 is manually operable to set the control parameters effective to concurrently control two or more of the tempo, timing, duration and volume of the original note data.

A transposer TP shifts note data NDp generated by the arpeggio sequencer AR or the pattern sequencer PS by a preset transpose value Ts, for executing transposition in which an arpeggio performance tone or a pattern performance tone is shifted (transposed) on a half tone basis. A shift parameter representative of this shift amount (transpose value) Ts can be controlled by operating a transposer knob Ntp on the input device 15, or by operating the operator panel 17.

Namely, the inventive automatic performance apparatus is responsive to a manual play of the keyboard 14K for producing either of an arpeggio performance and a pattern performance. In the inventive apparatus, the sequencer block AR or PS is responsive to the manual play for generating a sequence of original note data representing either of the arpeggio performance and the pattern performance. The transposer block TP shifts the original note data by a predetermined interval to thereby generate shifted note data. The tone generator block TS is receptive of the shifted note data for generating corresponding musical tones to thereby provide the transposed form of either of the arpeggio performance and the pattern performance. Preferably, the transposer block TP is controllable in real-time during either of the arpeggio performance and the pattern performance for changing a shift interval of the original note data to variably transpose the original note data.

A note effector NE adds the same note or a different note to the note data NDs obtained from the arpeggio sequencer AR or the pattern sequencer SP through the transposer TP, thereby changing tone properties or imparting fullness to a tone. As described below, three kinds of additional tone parameters can be specified to impart three effects at a time.

(1) Unison Un

Unison Un is an effect for adding a note of the same pitch to the original note data. This effect causes interference between tones, thereby changing the tone properties or tone qualities. The number Nu of notes (tones) to be added can be controlled by operating a unison knob Nun in a second effect knob group 15N2 on the operator panel 17.

(2) Octaver Oc

Octaver Oc is an effect for adding a note of the same pitch name but a different octave to the original note data. This effect causes to increase the fullness of a music tone. The octave value Ot of a note (tone) to be added can be controlled by operating an octaver knob Noc in the second effect knob group 15N2.

(3) Harmonizers Hm1, Hm2

Harmonizers Hm1 and Hm2 are effects for adding a note having a different pitch name. This effect increases the fullness of the music tones, or causes dissonance depending on an interval. Therefore, the dissonance can be caused intentionally. Interval values Th1 and Th2 of notes (tones) to be added can be controlled by operating harmonizer knobs Nh1 and Nh2 in the second effect knob group 15N2. Any number of harmonizers can be provided. In the example of FIG. 2, two harmonizers are provided.

Namely, the inventive automatic performance apparatus is responsive to a manual play of the keyboard 14K for producing either of an arpeggio performance and a pattern performance in a modified form. In the inventive apparatus, the sequencer block AR or PS is responsive to the manual play for generating a sequence of original note data representing either of the arpeggio performance and the pattern performance. The note effector block NE generates additional note data in superposed relation to the original note data such that the additional note data has the same pitch as that of the original note data, or the additional note data has the same pitch name as that of the original note data but a different octave than the original note data, or the additional note data has a predetermined interval relative to the original note data. The tone generator block TS is receptive of the original note data and the additional note data in superposed relation to each other for generating corresponding musical tones to thereby provide the modified form of either of the arpeggio performance and the pattern performance. Preferably, the note effector block NE is controllable in real-time during either of the arpeggio performance and the pattern performance for changing a number of the additional note data to variably modify the original note data. Further, the note effector block NE is controllable in real-time during either of the arpeggio performance and the pattern performance for changing the octave or the interval of the additional note data relative to the original note data to variably modify the original note data.

Because the present invention has the above-mentioned configuration, the original note data of the arpeggio performance generated by the arpeggio sequencer AR or the original note data of a predetermine pattern generated by the pattern sequencer PS can be shifted by the transposer TP by a predetermined interval simply by operating the transposer knob NtP. The note data NDs shifted by the transposer TP is sent to the tone generator module TS through the note effector NE. Therefore, the tone generator module TS requires no cumbersome operation for executing so-called transposition setting.

The note effector NE can generate the additional note data NDe of a predetermined pitch for the original note data of a predetermined pattern supplied from the arpeggio sequencer AR or the pattern sequencer PS. Namely, various control operations can be executed such as (1) generating additional note data of the same pitch in an overlapped manner by operating the unison knob Nun, (2) generating additional note data of the same pitch name but a different octave in an overlapping manner by operating the octaver knob Noc, and (3) generating additional note data separated from Each other by a preset interval in an overlapped manner by operating the harmonizer knobs Nh1 and Nh2. These pieces of the note data generated by the note effector NE are sent to the tone generator module TS together with the note data NDS to sound the corresponding tones. Consequently, the tone generator module TS needs no capability of sounding plural tones for one note.

Figure 3:
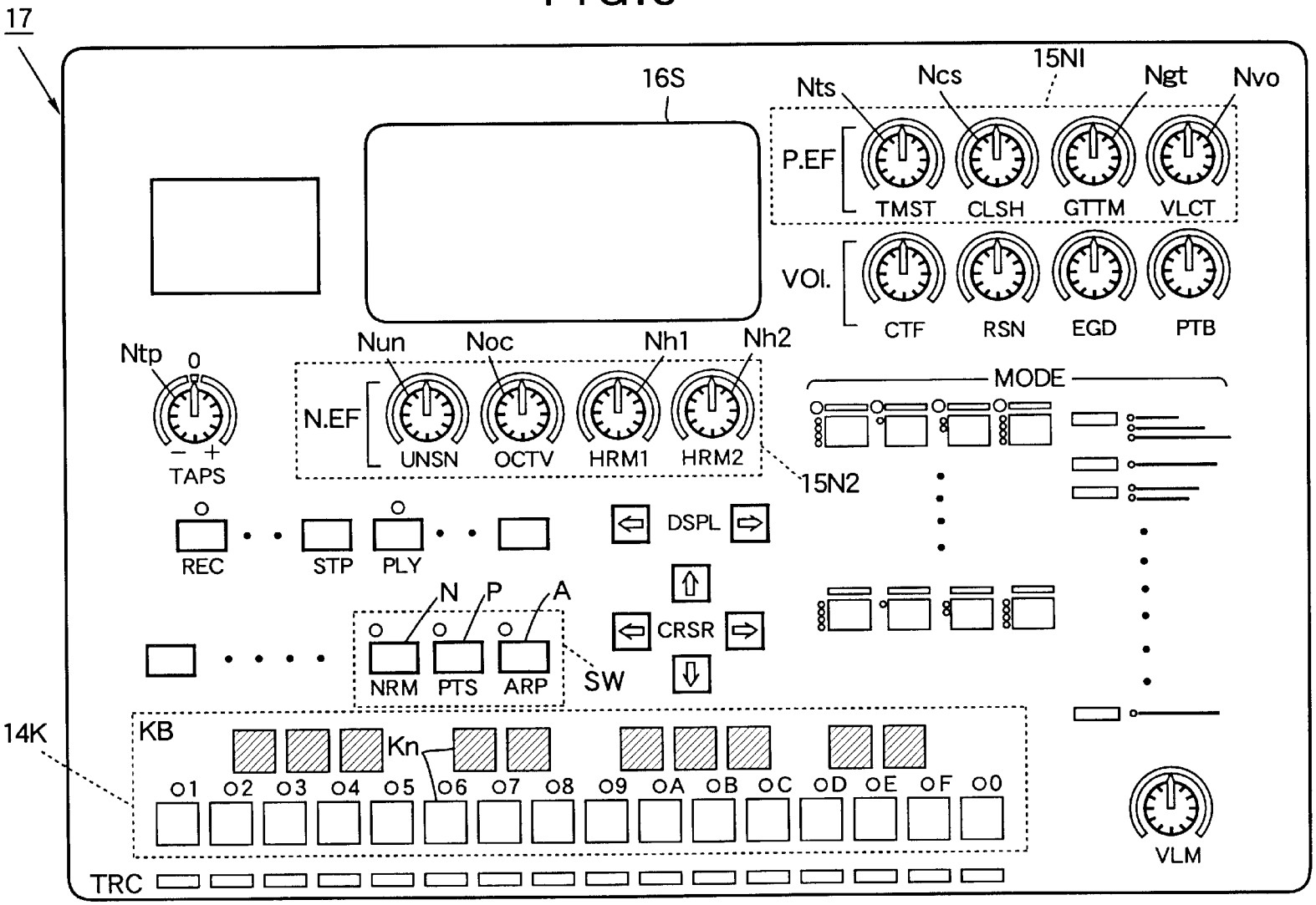
FIG. 3 is a front view of an operator panel of the automatic performance apparatus shown in FIG. 1.

FIG. 3 illustrates an example of the operator panel of the automatic performance apparatus practiced as one embodiment of the invention. In this example, the operator panel 17 of the automatic performance apparatus is integrally arranged with an operator control block including the switch input device 14 and the variable input device 15 and a display block including the display device 16. In the lower portion of the panel 17, the keyboard 14K is arranged. In the upper center, a main display screen 16S of the display device 16 is arranged. Between the keyboard 14K and the main display screen 16S, various operator controls are arranged such as the arpeggio performance key A, the pattern performance key P, and the normal performance key N with indicators corresponding to the performance selector switch SW shown in FIG. 2.

Moreover, on the operator panel 17, the first effect knob group 15N1, the transposer knob Ntp, and the second effect knob group 15N2 are arranged in correspondence to the play effector module PE, the transposer module TP, and the note effector module NE shown in FIG. 2.

In the present invention, the first effect knob group 15N1 includes the operator controls for changing realtime the performance tone parameters of the arpeggio performance tone and the pattern performance tone generated by the arpeggio sequencer module AR and the pattern sequencer module PS, respectively. For example, time stretch Ts, clock shift Cs, gate time Gt, and velocity offset Vo can be controlled by operating the time stretch knob Nts, the clock shift knob Ncs, the gate time knob Ngt, and the velocity offset knob Nvo, respectively. Therefore, the contents of the performance pattern of the arpeggio performance and the pattern performance can be changed realtime with ease during the automatic performance.

The transposer knob Ntp specifies the shift amount Ts of the transposer TP as a shift parameter. The second effect knob group 15N2 includes the unison knob Nun, the octaver knob Noc, and the harmonizer knobs Nh1 and Nh2 for specifying the additional tone parameters such as the number of additional notes Nu, additional note interval To, Th1, and Th2. Consequently, the shift parameter Ts and the additional tone parameters To, Th1, and Th2 can also be changed realtime with ease during the performance, thereby realizing a wide variety of performance in which the tone properties of the automatic performance and the contents of the automatic performance can be varied real-time.

[Other embodiments]

The above-mentioned embodiment of the invention uses rotary knobs as the operator controls for setting various parameters. The operator controls are not limited to the knob type. They may be of a slide type, a touch-plate type, and so on. One operator control is not necessarily assigned to one parameter. Plural parameters may share one operator control.

As mentioned above and according to the invention, performance tone parameters such as tempo, timing, time duration, and volume of note data are specified. The original note data corresponding to the arpeggio performance or the pattern performance is generated according to key operation. The generated note data is manipulated on the basis of the specified performance tone parameters. The manipulated note data is shifted by a predetermined interval according to the operation of an operator control. The shifted note data is overlapped by additional note data which is the same as the shifted note data in pitch, or the same as the shifted note data in pitch name but different in octave, or separated from the shifted note data by a preset interval according to the operation of another operator control. These note data are finally supplied to the tone generator to sound corresponding tones.

Thus, according to the present invention, the original note data of the arpeggio performance or the original note data of the pattern performance is overlapped by means of the performance data adding capability with the additional note data which is the same as the original note data in pitch, or the same as the original note data in pitch name but different in octave, or separated from the original note data by a preset interval according to the operation of another operator control. Alternatively, the note data of the arpeggio performance or the note data of the pattern performance is shifted by means of the performance data shift capability by a predetermined interval. The shifted note data are supplied to the tone generator.

Consequently, even if the tone generator has no capability of generating plural tones for one note, fullness can be imparted to tones of the arpeggio performance or the pattern performance, and the properties of the original tone can be changed by generating plural additional tones for one note. This generates modified arpeggio performance tones or modified pattern performance tones having different pitches with the same key kept depressed and without executing transposition setting on the side of the tone generator.

In addition, according to the present invention, the operator panel of the automatic performance apparatus is arranged with operator controls for changing real-time arpeggio performance tone parameters and pattern performance tone parameters (such as time stretch, clock shift, gate time, and velocity offset). Consequently, the contents of the arpeggio performance and the pattern performance can be changed real-time with ease during the automatic performance. Further, the provision of the operator controls for specifying a shift parameter and various additional tone parameters realizes more effectively a wide variety of automatic performance in which the tone properties and contents of performance can be varied real-time.

What is claimed is:

1. An automatic performance apparatus responsive to a manual play of an input implement for producing either of an arpeggio performance and a pattern performance in a modified form, the apparatus comprising:

a sequencer block responsive to the manual play for generating a sequence of original note data representing either of the arpeggio performance and the pattern performance;

a note effector block that is controllable in real-time during either of the arpeggio performance and the pattern performance for generating additional note data in superposed relation to the original note data such that the additional note data has the same pitch as that of the original note data, or the additional note data has the same pitch name as that of the original note data but a different octave than the original note data, or the additional note data has a predetermined interval relative to the original note data; and a tone generator block receptive of the original note data and the additional note data in superposed relation to each other for generating corresponding musical tones to thereby provide the modified form of either of the arpeggio performance and the pattern performance.

2. The automatic performance apparatus according to claim 1, wherein the note effector block is controllable in real-time during either of the arpeggio performance and the pattern performance for changing a number of the additional note data to variably modify the original note data.

3. The automatic performance apparatus according to claim 1, wherein the note effector block is controllable in real-time during either of the arpeggio performance and the pattern performance for changing the octave or the interval of the additional note data relative to the original note data to variably modify the original note data.

4. An automatic performance apparatus responsive to a manual play of an input implement for producing either of an arpeggio performance and a pattern performance in a transposed form, the apparatus comprising:

a sequencer block responsive to the manual play for generating a sequence of original note data representing either of the arpeggio performance and the pattern performance;

a transposer switch that is controllable in real-time during either of the arpeggio performance and the pattern performance for shifting the original note data by a predetermined interval to thereby generate shifted data; and a tone generator block receptive of the shifted note data for generating corresponding musical tones to thereby provide the transposed form of either of the arpeggio performance and the pattern performance.

5. The automatic performance apparatus according to claim 4, wherein the transposer block is controllable in real-time during either of the arpeggio performance and the pattern performance for changing a shift interval of the original note data to variably transpose the original note data.

6. An automatic performance apparatus responsive to a manual play of an input implement for producing either of an arpeggio performance and a pattern performance in a modified form, the apparatus comprising:

a sequencer block responsive to the manual play for generating a sequence of original note data representing either of the arpeggio performance and the pattern performance;

an input block manually operable to set control parameters effective to control at least one of a tempo, a timing, a duration and a volume of the original note data;

a play effector block that is controllable in real-time during either of the arpeggio performance and the pattern performance for processing the original note data according to the control parameters to generate altered note data; and a tone generator block receptive of the altered note data for generating corresponding musical tones to thereby provide the modified form of either of the arpeggio performance and the pattern performance.

7. The automatic performance apparatus according to claim 6, wherein the input block is manually operable to set the control parameters effective to concurrently control two or more of the tempo, timing, duration and volume of the original note data.

8. An automatic performance apparatus responsive to a manual play of an input implement for producing either of an arpeggio performances and a pattern performance in a modified form, the apparatus comprising:

a sequencer block responsive to the manual play for generating a sequence of original note data representing either of the arpeggio performance and the pattern performance;

an input block manually operable to set control parameters effective to control at least one of a tempo, a timing, a duration and a volume of the original note data;

a play effector block that is controllable in real-time during either of the arpeggio performance and the pattern performance for processing the original note data according to the control parameters to generate altered note data;

a transposer that is controllable in real-time during either of the arpeggio performance and the pattern performance for shifting the altered note data by a predetermined interval to thereby generate shifted note data;

a note effector block that is controllable in real-time during either of the arpeggio performance and the pattern performance for generating additional note data in superposed relation to the shifted note data such that the additional note data has the same pitch as that of the shifted note data, or the additional note data has the same pitch name as that of the shifted note data but a different octave than the shifted note data, or the additional note data has a predetermined interval relative to the shifted note data; and a tone generator block receptive of the shifted note data and the additional note data for generating corresponding musical tones to thereby provide the modified form of either of the arpeggio performance and the pattern performance.

9. The automatic performance apparatus according to claim 8, wherein the input block is manually operable to set the control parameters effective to concurrently control two or more of the tempo, timing, duration and volume of the original note data.

10. An automatic performance method responsive to a manual play of an input implement for producing either of an arpeggio performance and a pattern performance in a modified form, the method comprising the steps of:

generating a sequence of original note data representing either of the arpeggio performance and the pattern performance in response to the manual play;

generating additional note data in superposed relation to the original note data such that the additional note data has the same pitch as that of the original note data, or the additional note data has the same pitch name as that of the original note data but a different octave than the original note data, or the additional note data has a predetermined interval relative to the original note data; and processing the original note data and the additional note data in superposed relation to each other for generating corresponding musical tones to thereby provide the modified form of either of the arpeggio performance and the pattern performance, wherein the step of generating additional note data is controllable in real-time during either of the arpeggio performance and the pattern performance.

11. An automatic performance method responsive to a manual play of an input implement for producing either of an arpeggio performance and a pattern performance in a transposed, the method comprising the steps of:

generating a sequence of original note data representing either of the arpeggio performance and the pattern performance in response to the manual play;

shifting the original note data by a predetermined interval to thereby generate shifted note data: and processing the shifted note data for generating corresponding musical tones to thereby provide the transposed form of either of the arpeggio performance and the pattern performance, wherein the step of shifting the original note data is controllable in real-time during either of the arpeggio performance and the pattern performance.

12. An automatic performance method responsive to a manual playof an input implement for producing either of an arpeggio performance and a pattern performance in a modified form, the method comprising the steps of:

generating a sequence of original note data representing either of the arpeggio performance and the pattern performance in response to the manual play of the input implement;

setting control parameters effective to control at least one of a tempo, a timing, a duration and a volume of the original note data;

processing the original note data according to the control parameters to generate altered note data; and processing the altered note data so as to generate corresponding musical tones to thereby provide the modified form of either of the arpeggio performance and the pattern performance, wherein the step of processing the original note data is controllable in real-time during either of the arpeggio performance and the pattern performance.

13. A computer readable medium for use in an automatic performance apparatus having a central processor and being responsive to a manual play of an input implement for producing either of an arpeggio performance and a pattern performance in a modified form, the medium containing program instructions executable by the central processor for causing the automatic performance apparatus to perform a process comprising the steps of:

generating a sequence of original note data representing either of the arpeggio performance and the pattern performance in response to the manual play;

generating additional note data in superposed relation to the original note data such that the additional note data has the same pitch as that of the original note data, or the additional note data has the same pitch name as that of the original-note data but a different octave than the original note data, or the additional note data has a predetermined interval relative to the original note data; and processing the original note data and the additional note data in superposed relation to each other for generating corresponding musical tones to thereby provide the modified form of either of the arpeggio performance and the pattern performance, wherein the step of generating additional note data is controllable in real-time during either of the arpeggio performance and the pattern performance.

14. A computer readable medium for use in an automatic performance apparatus having a central processor and being responsive to a manual play of an input implement for producing either of an arpeggio performance and a pattern performance in a transposed form, the medium containing program instructions executable by the central processor for causing the automatic performance apparatus to perform a process comprising the steps of:

generating a sequence of original note data representing either of the arpeggio performance and the pattern performance in response to the manual play;

shifting the original note data by a predetermined interval to thereby generate shifted note data; and processing the shifted note data for generating corresponding musical tones to thereby provide the transposed form of either of the arpeggio performance and the pattern performance, wherein the step of shifting the original note data is controllable in real-time during either of the arpeggio performance and the pattern performance.

15. A computer readable medium for use in an automatic performance apparatus having a central processor and being responsive to a manual play of an input implement for producing either of an arpeggio performance and a pattern performance in a modified form, the medium containing program instructions executable by the central processor for causing the automatic performance apparatus to perform a process comprising the steps of:

generating a sequence of original note data representing either of the arpeggio performance and the pattern performance in response to the manual play of the input implement;

setting control parameters effective to control at least one of a tempo, a timing, a duration and a volume of the original note data;

processing the original note data according to the control parameters to generate altered note data; and processing the altered note data so as to generate corresponding musical tones to thereby provide the modified form of either of the arpeggio performance and the pattern performance, wherein the step of processing the original note data is controllable in real-time during either of the arpeggio performance and the pattern performance.

16. An automatic performance method responsive to a manual play of an input element for producing either of an arpeggio performance and a pattern performance in a modified form, the method comprising the steps of:

generating a sequence of original note data responsive to the manual play for representing either of the arpeggio performance and pattern performance;

setting control parameters effective to control at least one of a tempo, a timing, a duration and a volume of the original note data;

processing the original note data according to the control parameters to generate an altered note data, wherein said step of processing the original note data is controllable in real-time during either of the arpeggio performance and the pattern performance;

shifting the altered note data by a predetermined interval to thereby generate shifted note data, wherein said step of shifting the altered note data is controllable in real-time during either of the arpeggio performance and pattern performance;

generating an additional note data in superposed relation to the shifted note data such that the additional note data has the same pitch as that of the shifted note data, or the additional note data has the same pitch name as that of the shifted note data but a different octave than the shifted note data, wherein said step of generating an additional note data is controllable in real-time during either of the arpeggio performance and the pattern performance; and generating musical tones based upon the shifted note data and the additional note data to thereby provide a modified form of either of the arpeggio performance and the pattern performance.

17. A computer readable medium for use in an automatic performance apparatus having a central processor and being responsive to a manual play of an input implement for producing either of an arpeggio performance and a pattern performance in a modified form, the medium containing program instructions executable by the central processor for causing the automatic performance apparatus to perform a process comprising the steps of:

generating a sequence of original note data responsive to the manual play for representing either of the arpeggio performance and pattern performance;

setting control parameters effective to control at least one of a tempo, a timing, a duration and a volume of the original note data;

processing the original note data according to the control parameters to generate an altered note data, wherein said step of processing the original note data is controllable in real-time during either of the arpeggio performance and the pattern performance;

shifting the altered note data by a predetermined interval to thereby generate shifted note data, wherein said step of shifting the altered note data is controllable in real-time during either of the arpeggio performance and pattern performance;

generating an additional note data in superposed relation to the shifted note data such that the additional note data has the same pitch as that of the shifted note data, or the additional note data has the same pitch name as that of the shifted note data but a different octave than the shifted note data, wherein said step of generating an additional note data is controllable in real-time during either of the arpeggio performance and the pattern performance; and generating musical tones based upon the shifted note data and the additional note data to thereby provide a modified form of either of the arpeggio performance and the pattern performance.

* * * * *